US007100307B2

(12) United States Patent
Burke et al.

(10) Patent No.: US 7,100,307 B2
(45) Date of Patent: Sep. 5, 2006

(54) FOOTWEAR TO ENHANCE NATURAL GAIT

(75) Inventors: Robert G. Burke, Barrie (CA); Roy J. W. Gardiner, Richmond Hill (CA)

(73) Assignee: Barefoot Science Technologies Inc., Toronto (CA)

( * ) Notice: Subject to any disclaimer, the term of this patent is extended or adjusted under 35 U.S.C. 154(b) by 179 days.

(21) Appl. No.: 09/929,072

(22) Filed: Aug. 15, 2001

(65) Prior Publication Data

US 2003/0033730 A1 Feb. 20, 2003

(51) Int. Cl.
*A43B 13/18* (2006.01)

(52) U.S. Cl. ..... 36/25 R; 36/28; 36/30 R; 36/102

(58) Field of Classification Search ..... 36/44, 36/43, 45, 145, 155, 159, 166, 102
See application file for complete search history.

(56) References Cited

U.S. PATENT DOCUMENTS

| | | | | | |
|---|---|---|---|---|---|
| 511,942 | A | * | 1/1894 | Glanville | 36/43 |
| 1,336,979 | A | * | 4/1920 | Plummer | 36/178 |
| 1,841,942 | A | * | 1/1932 | Fenton | 36/145 |
| 1,907,136 | A | * | 5/1933 | Weitsen | 36/145 |
| 1,927,889 | A | * | 9/1933 | Doty et al. | 36/182 |
| 2,101,761 | A | * | 12/1937 | Stagl | 36/145 |
| 2,154,997 | A | * | 4/1939 | Schipper | 36/166 |
| 2,184,456 | A | * | 12/1939 | Knapp | 36/180 |
| 2,211,057 | A | * | 8/1940 | Duckoff | 36/103 |
| 2,423,622 | A | * | 7/1947 | Samblanet | 36/176 |
| 4,020,570 | A | * | 5/1977 | Shames | 36/44 |
| 5,068,983 | A | * | 12/1991 | Marc | 36/44 |
| D334,282 | S | * | 3/1993 | Greene | D2/953 |
| 5,448,839 | A | | 9/1995 | Blissett et al. | 36/25 R |
| 6,014,824 | A | | 1/2000 | Gumbert | 36/103 |
| 6,301,807 | B1 | * | 10/2001 | Gardiner | 36/155 |
| 2001/0005947 | A1 | * | 7/2001 | Sordi | 36/102 |

FOREIGN PATENT DOCUMENTS

| | | |
|---|---|---|
| EP | 1 199 001 A1 | 7/1998 |
| WO | WO 00/54616 | 3/2000 |

OTHER PUBLICATIONS

Communication pursuant to Article 96(2) EPC, European Patent Office Examination Report for Application No. 02 754 016/0, dated Nov. 30, 2005.

Communication pursuant to Article 96(2), EPC, European Patent Office Examination Report for Application No. 02 754 016/0, dated Jul. 9, 2004.

* cited by examiner

*Primary Examiner*—Ted Kavanaugh
(74) *Attorney, Agent, or Firm*—Gowling Lafleur Henderson LLP; Peter Milne

(57) ABSTRACT

An article of footwear that acts to strengthen the foot through biofeedback, reduces stresses on the foot that occur during impact through midsole/outsole design characteristics, and enhances the foot's ability to pre-stabilize itself prior to striking the ground by utilizing the foot's "Windlass Effect".

8 Claims, 6 Drawing Sheets

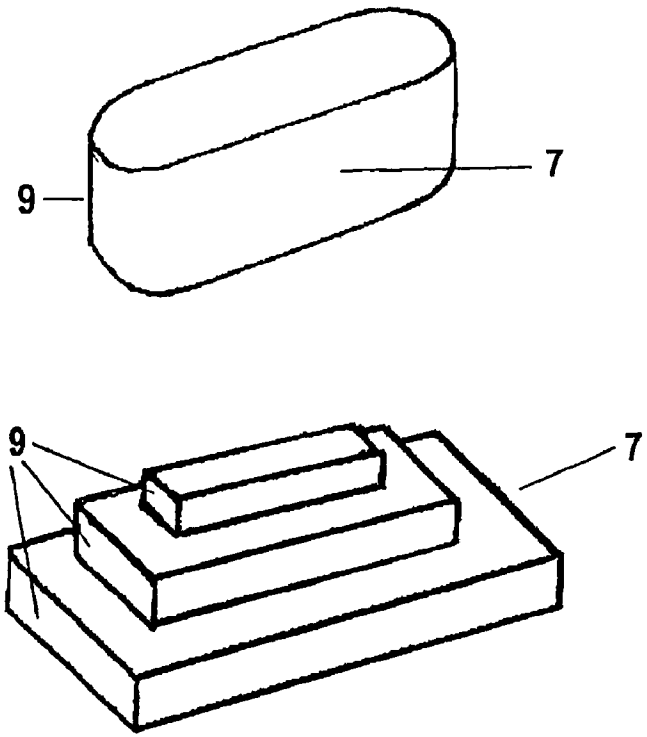
Fig. 4
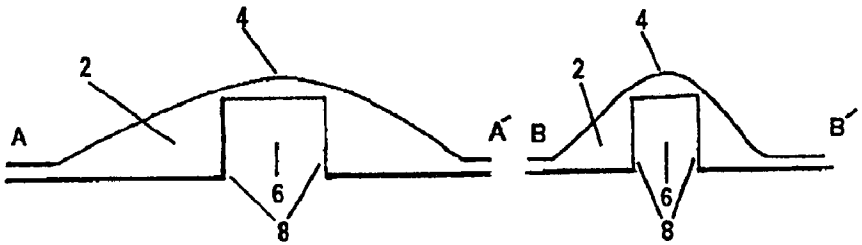
Fig 3A
Fig 3B

FOOTWEAR TO ENHANCE NATURAL GAIT

BACKGROUND OF THE INVENTION

Over the past century the philosophies surrounding the treatment of gait related pathologies, biomechanics and footwear development have largely been based on principles of the introduction of artificial or synthetic bracing and cushioning devices. In the vast majority of cases those experiencing some form of gait related pathology or symptom are prone to those pathologies or symptoms as a result of the atrophy of the foot and supporting musculature. It is well founded in medical research that the act of bracing results in the atrophy of the musculoskeletal system being braced. It is rather paradoxical therefore that the methods used to treat symptoms arising from an atrophied musculoskeltal structure further perpetuate the weakening. It is not uncommon for the symptoms to be alleviated for the short term (during bracing) but then for the original symptoms or others linked to faulty biomechanics and weakened structure to again manifest themselves.

It is also well documented that the incidence of similar gait related pathologies and symptoms in countries whose inhabitants are largely unshod, or barefoot, are a fraction of those seen in countries where it is commonplace to be shod. This discrepancy in incidence can be directly attributed to footwear and the apparent faults in the design of footwear. The inability of the typical shoe to work in unison with the mechanics of the foot can be seen as the greatest influencer of gait and foot related problems. Restricting the foot's natural motion and mechanics creates unwarranted and magnified stresses that resulting in the creation of faulty biomechanics, discomfort and injury.

SUMMARY OF THE INVENTION

It is an object of the present invention to provide to a wearer an article of footwear wherein the design, manufacture and geometric characteristics enhance and accentuate the natural motion of the wearer's foot during the gait cycle. Such an article of footwear promises to be of immense value to all its wearers, providing benefits which are both rehabilitative and preventive.

According to one aspect of the present invention, the article of footwear includes aligning of a substantially dome shaped catalyst for alignment with a pre-determined target area located on the plantar aspect of the foot for the purpose of creating a biofeedback reflex response causing contraction of the foot's supporting musculature. Provision may be made to allow for a cautious and gradual progression of the amount of pressure generated by the dome shaped catalyst to the target area. The target area is definable as a region approximating the intersection of the navicular, the lateral cuneiform and the cuboid bones of the foot.

Early patents have proposed the use of an innersole device and through devices whose function is not consistent with the desired properties of the above dome shaped catalyst. Burke et al in U.S. Pat. No. 5,404,659 disclose an innersole and/or midsole configuration with a dome shaped catalyst displaying compression and rebound properties far in excess of that tolerable by the human foot. Evidence of this has been seen by those skilled in the art of therapeutic insole application and those having familiarity with the usage of a product as disclosed in U.S. Pat. No. 5,404,659.

As will be disclosed herein the desired rebound, deflection, and compression properties of the dome shape catalyst are such that when the dome shape catalyst is subjected to the compressive force consistent with daily weight bearing activities, the apex of said catalyst will have a maximum height of between 1% and 5% of the foot's total length. A mild pressure created by the dome shaped catalyst acts to create muscle contractions through the interaction of the pressure and the Golgi Tendon organs of the supporting muscles of the foot. The repetitive muscle contractions function as a progressive resistance program resulting in a gradual strengthening of the muscles of the foot. This approach is consistent with the use of other biofeedback relationships and stimuli to create muscle contractions.

U.S. Pat. No. 5,404,659 discloses a concept of providing replaceable inserts that are alignable with and become part of the dome shaped catalyst. In U.S. Pat. No. 5,404,659 the insert and the receiving portion of the dome shaped catalyst are curvilinear in nature and testing by those skilled in the art has revealed that this design was not satisfactory in either securing the placement of the insert in the receiving portion of the innersole or providing for ease of removal and insertion. It was found that the application of the removable insert into the receiving portion was best achieved through the use of an adhesive substance. This however presented two distinct limitations, firstly substances displaying adhesion properties enabling ease of removal of the insert proved to be not substantial enough to secure the placement of the removable insert in the desired location; secondly substances with adhesion properties of such magnitude as to ensure the maintenance of the removable insert in the desired location proved to cause damage to the materials making up the insole body and the materials making up the removable insert.

One intent of the present invention is to improve on the concept of introducing a biofeedback catalyst to the plantar aspect of the foot by improving on the deflection, rebound, and compression properties to allow the invention to be more usable. Another intent of the present invention is to provide a superior means through which to allow for the removability of the removable insert.

According to other aspects of the present invention, a novel midsole/outsole arrangement is provided that enhances and promotes the natural motion of the foot during the initial contact, or foot strike, phase of the gait cycle as well as provisions in the upper of the shoe to enhance the mechanics of the foot during the swing phase of the gait cycle.

Those skilled in the art of footwear development, gait biomechanics and orthotics fabrication have collectively agreed that the initial contact phase of the gait cycle is of paramount importance in attempting to control the motions of the gait cycle. The gait cycle can be briefly described as the motions of the foot and body as the foot contacts the ground, accepts the body weight, leaves the ground and then contacts the ground again. Traditionally attempts to control faulty biomechanics that occur during the gait cycle have been addressed by bracing the foot at the point of contact. Those skilled in the art have acknowledged that excessive rolling of the foot from the lateral or outside, to the medial or inside, boundary of the foot, commonly referred to as excess pronation, can be a leading cause of chronic foot problems. Yet traditional footwear midsole and outsole designs have created environments that perpetuate and magnify the problems and faulty mechanics.

The traditional approach has long been to introduce, through the midsole/outsole geometry, a wide stable base of support for the foot. Examples of these are clearly shown in Lyden et al, U.S. Pat. No. 5,625,964; Truelsen, PCT Appl. DK88/00203; Whatley, U.S. Pat. No. 5,005,299; Halberstadt, U.S. Pat. No. 4,259,792; Stubblefield, U.S. Pat. No. 4,372,058; Giese et al, U.S. Pat. No. 4,316,335 and Brooks, U.S. Pat. No. 4,272,899, to name a few.

However those skilled in the art of biomechanical analysis acknowledge that the most common point of contact of the foot is on the plantar posterior most aspect of the foot, just lateral to the long axis of rotation of the foot through the calcaneus. This condition and desired point of location is however most notably attributable to the barefoot condition. When footwear is introduced, as disclosed in the above patents, the point of initial contact is forced dramatically to the furthest most lateral aspect of the footwear midsole/outsole. This however dramatically increases the lever arm and torque on the foot. This midsole/outsole configuration is not only characteristic to the lateral aspect of the midsole/outsole, but also to the medial aspect. During multi-directional sports this midsole/outsole configuration also produces increased torque and accelerations on the foot and body. In an attempt to provide a novel midsole geometry for court sports Hamey et al, U.S. Pat. No. 4,559,723 discloses a midsole/outsole configuration wherein the medial aspect is radiused to allow for enhanced lateral movements during court sport activities. There still remains an issue of an increased lever arm effect when the shoe's midsole/outsole contacts the support surface on the lateral aspect.

Through a novel midsole/outsole arrangement the inventors propose a geometry that allows the foot contact to simulate that of being barefoot. The midsole/outsole arrangement of the present invention is designed such that the wearing layer which contacts the ground or support surface first is configured to provide a smooth radius from the lateral to the medial aspect with the central point of the radius being aligned with the long axis of rotation of the foot through the calcaneus. In this manner no abrupt torques or accelerations are produced as the foot contacts the support surface and slowly comes to rest in a flattened position.

According to another aspect of the present invention provision is made to enhance the probability of the wearer's foot coming to rest in a biomechanically correct position as the foot slowly comes to rest after contacting the ground or support surface. This is accomplished through the introduction of a cushioning region directly beneath the mass of the calcaneus or heel bone. The cushioning region is of a resiliency as to be substantially lower than that of the midsole/outsole arrangement making up the periphery of the cushioning region.

According to another aspect of the present invention, provision is made to enhance the foot's preparation for initial contact. Those skilled in the art of gait biomechanics, especially those with experience in the analysis and observation of unshod persons recognize the importance of allowing for the maximal dorsi flexion of the hallux, or big toe, prior to initial contact. Arguably, at the core of gait biomechanics is the notion of the Windlass Effect. This is a pulley system involving connective tissue on the plantar aspect of the foot, notably the plantar fascia, and the pulling of the plantar fascia around the sesamoid bones at the first metatarsal phalangeal joint. The plantar fascia is pulled, and as a result tightens by the dorsi flexing of the hallux. As it is pulled tight it ensures the structural integrity of the foot in preparation for initial contact. Evidence of this can be most clearly seen in observing the shoes worn by runners during the running boom of the early to mid 1970's. It was commonplace for the big toe or hallux to protrude up through the toe box of the running shoe. This was the result of the foot attempting to stabilize itself.

In response to the premature wearing of the toe box of the running shoe the leading shoe companies of the time responded by reinforcing the toe box with stronger more durable materials and in essence preventing the foot being able to attain natural and ideal gait biomechanics. Dannenberg in U.S. Pat. Nos. 4,608,988 and 4,597,195 demonstrates an acknowledgment of the importance of the dorsi flexing of the hallux and in an effort to provide the hallux with a greater potential range of motion included provisions beneath the head of the first metatarsal to increase the range of motion. However those skilled in the art have seen that when the provisions of Dannenberg are incorporated into the design of shoes or supports that there is a distinct tendency for the biomechanics of the wearer to be altered negatively. Namely the wearer is encouraged to have their foot stay in a pronated position for a much longer than ideal duration.

A common limitation of current footwear designs is that the maximal dorsi flexion of the hallux is limited because the action of dorsi-flexion is in opposition to the flexibility pre-dispositions of the midsole/outsole arrangement and is obstructed by the toe box of the shoe.

According to the present invention, the enhancement of the dorsi flexion of the hallux prior to initial contact is achieved through a combination of alterations to the shoe midsole/outsole as well as the introduction of mechanisms functioning as strain resistance devices wherein during the swing phase of gait the hallux is encouraged to dorsi-flex. In this manner the optimal structural integrity of the foot is enhanced and as well, the foot is pre-stressed ready to accommodate the body weight of the person. This allows for maximal usage of the muscles of the plantar aspect of the foot. With the foot in a state of optimal structural integrity the plantar muscles can be used eccentrically. Those skilled in the art of muscle physiology have long recognized that muscles are better equipped to respond to forces when they can contract in an eccentric manner, as well the muscles have inherent spring properties that can also be better utilized during eccentric muscle contractions.

Designs have been proposed for storing impact energy by integrating mechanical devices into footwear. Examples of these are McMahon et al, U.S. Pat. No. 4,342,158, Burke et al, U.S. Pat. No. 5,212,878; Schindler, U.S. Pat. No. 5,343,637; Whatley, U.S. Pat. No. 5,060,401, Schmid, U.S. Pat. No. 4,585,338, Barry et al, U.S. Pat. No. 5,052,130; Crowley, U.S. Pat. No. 4,881,329; and Kilgore et al, U.S. Pat. No. 5,343,639. Unfortunately all of these have forefoot flexibility and toe box limitations that restrict the foot's natural ability to pre stabilize itself and use it's own muscle properties to store and return energy.

In summary, it is an object of the present invention to present novel design and mechanical provisions in an article of footwear that act to strengthen the foot through biofeedback, reduce stresses on the foot that occur during impact, and enhance the foot's ability to pre-stabilize itself prior to striking the ground.

DESCRIPTION OF DRAWINGS

Preferred embodiments of the present invention will now be described, by way of example only, with reference to the attached drawings, in which:

FIGS. 3A and 3B are respectively a frontal and a sagittal plane cross section of a midsole/outsole unit as taken respectively, through section 3A–3A' and 3B–3B' of FIG. 2;

FIG. 4 is a perspective view of a removable resilient member that may be inserted in a receptacle outlined in FIG. 3;

DETAILED DESCRIPTION

Figure 1:
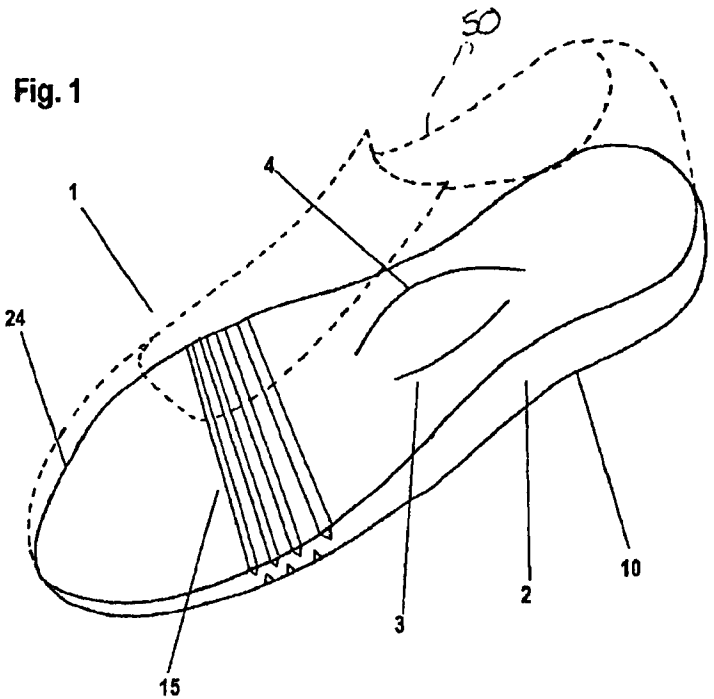
FIG. 1 is a dorsal aspect perspective view of one of the embodiments of the invention illustrating a midsole/outsole unit with an outline of a shoe upper positioned superior to the midsole/outsole arrangement, and a proposed location for the integration of flex grooves or channels.

With reference to FIG. 1 there is disclosed an article of footwear 1 with a distinctive box 24 and a midsole/outsole 2, the midsole/outsole 2 has a distinctive wearing layer 10 positioned such that the wearing layer 10 is the first portion of the article of footwear 1 to come in contact with the ground or support surface during the gait cycle. The article of footwear 1 also has a midsole/outsole 2 with a substantially dome shaped catalyst 3 which has a distinctive apex 4. The midsole/outsole 2 has flex grooves or channels 15 extending thereacross which enhance the natural dorsiflexion of the foot. The flex grooves or channels 15 are of such design as to allow the substantially unrestricted dorsi-flexion of the midsole/outsole 2 through the metatarsal region 14 and more specifically through the line of flexion 16 as illustrated in FIG. 2.

The article of footwear 1 can be manufactured according to any of the standard manufacturing methods including slip, combination, stroble and board lasting. The article of footwear 1 has an upper 50 which may be fabricated of a variety of materials typically used in footwear design and manufacturing with the provision that the materials comprising said toe box 24 display characteristics consistent with the allowance of maximal dorsi-flexion of the hallux. The midsole/outsole 2 may also be manufactured by any of a variety of manufacturing methods common to the footwear industry including compression molding, pouring and injection, and may be formed from a variety compounds displaying the desired midsole outsole characteristics including foam based PVC, EVA and Polyurethane.

Figure 2:
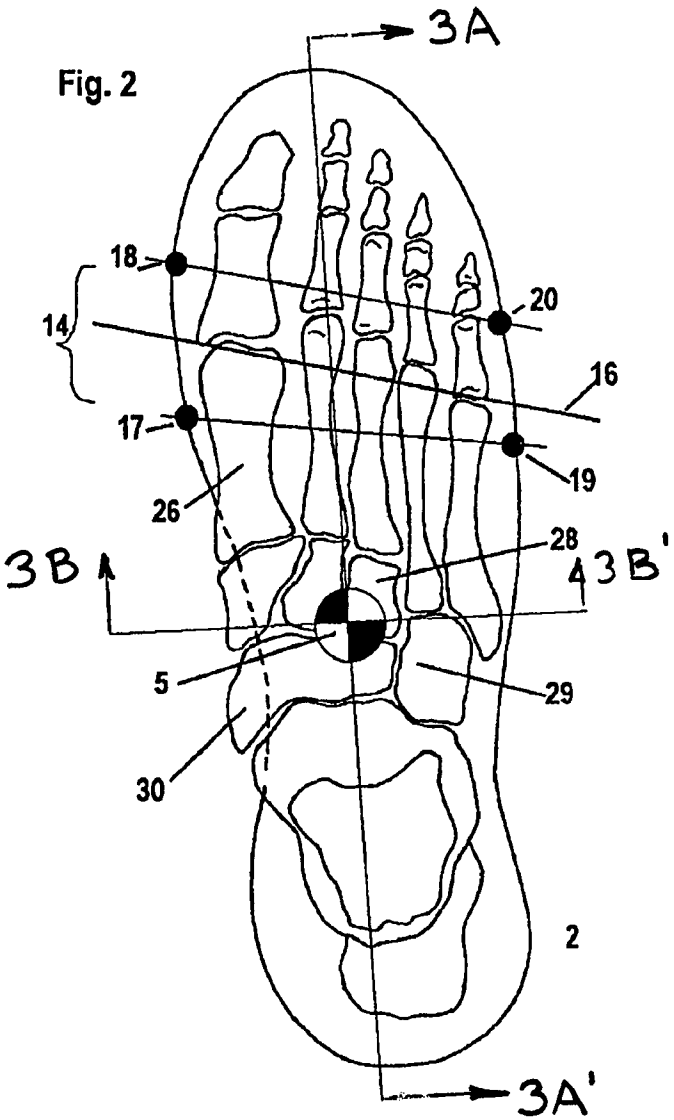
FIG. 2 is a dorsal aspect view of a foot, positioned superior to the midsole/outsole unit, in a desired location such that the target area of the foot is aligned to substantially dome shaped catalyst. Also provided is an indication of the flex region of the foot and corresponding flex region of the midsole/outsole arrangement.

FIG. 2 illustrates a dorsal view of a human foot positioned as desired superior or dorsal to the midsole/outsole unit 2 wherein a desired target area 5 of the foot is aligned with the apex 4 of the substantially domed shaped catalyst 3. The target area 5 is definable as the region of the foot approximating the intersection of the lateral cuneiform 28, the cuboid 29 and the navicular 30.

Preferably the rebound, deflection, and compression properties of the dome shape catalyst 3 are such that when the dome shape catalyst 3 is subjected to compressive forces consistent with daily weight bearing activities, the apex 4 of the dome shaped catalyst 3 will have a maximum height of between 1% and 5% of the foot's total length. The mild pressure created by dome shaped catalyst 3 acts to create muscle contraction through the interaction of the pressure and the Golgi Tendon organs of the supporting muscles of the foot. The repetitive muscle contractions function as a progressive resistance program resulting in a gradual strengthening of the muscles of the foot.

FIG. 2 also illustrates a desired location of the flex grooves or channels 15 (in FIG. 1). In FIG. 2 reference 14 identifies a "metastarsal region" which incorporates the natural flex location of the forefoot, namely the metatarsal-phalangeal joints of the foot. The flex grooves or channels 15 preferably extend across the metatarsal region 14 and parallel a desired line of flexion 16. In order to accommodate a variety of toe to foot length ratios the preferred embodiment has a zone of enhanced flexibility in the sagittal plane through the metatarsal region 14. This may be achieved by having flex grooves or channels 15 incorporated into the midsole design running parallel to the line of flexion 16 created by the articulations of metatarsal-phalangeal joints. The flex grooves or channels 15 are preferably located within a region defined on the medial aspect of the foot by a medial posterior boundary 17 not less than 70% of the foot's length and a medial anterior boundary 18 not more than 80% of the foot's length and on the lateral aspect of the foot by a lateral posterior boundary 19 not less than 60% of the foot's total length and a lateral anterior boundary 20 not more than 70% of the foot's length. Through the incorporation of the flex grooves or channels 15 corresponding to the above, the shoe's midsole/outsole 2 is capable of dorsi-flexing in unison with the foot to enhance the attainment of ideal gait biomechanics, particularly through the swing phase when the foot is in the air preparing to strike the ground while entering into the next step, or contact phase.

FIG. 2 also illustrates lines of reference A–A' and B–B', which intersect the apex 4 of the dome shaped catalyst 3 and act to define the cross-sectional views of FIG. 3. With reference to FIG. 3, detailing the cross sections of the dome shaped catalyst 3 through an anterior-posterior cross section, A–A' and a medial-lateral cross section B–B' through its apex 4, the cross sectional characteristics of the dome shaped catalyst 3 and its apex 4 are illustrated as well as characteristics of a receptacle 6 capable of receiving a removable resilient member 7 as shown in FIG. 4.

The resilient member 7 act s to define the compression, rebound and deflection characteristics of the dome shaped catalyst 3 by comprising the majority of the volume of the dome shape catalyst 3. As disclosed in Burke et al, U.S. Pat. No. 5,404,659 it is desirable to introduce to the planter aspect of the foot, in the target area 5, a pressure to stimulate muscular contractions and through which to create a strengthening of the foot's intrinsic muscles. However to best enable this rehabilitative process, accommodation must be presented to enable an efficient removal and insertion of the resilient member 7. The shortcomings of the design of the U.S. Pat. No. 5,404,659 have been previously discussed and are overcome by the arrangement illustrated in FIG. 3 which incorporates a receptacle 6 having vertical sidewalls 8 for the purpose of securing the resilient member 7 in place and affording an ease of removability.

As shown in FIG. 4, the resilient member 7 has vertical sides 9 for aligning with the vertical sidewalls 8 of the receptacle 6. To provide the desired rebound, compression and deflection properties, the resilient member 7 may be fabricated from a variety of materials known to those skilled in the art of foam fabrication and utilization and the incorporation of these into articles of footwear and the like. These may include foams with EVA, PVC or polyurethane composition as well as mediums through which the desired properties are attainable through the incorporation of visco-elastic polymers. These are but a few examples of preferred materials and the composition of the resilient member 7 need not be limited to these materials. The resilient member 7 may be fabricated through a variety of means known to those skilled in the art, for example injection, pouring, stamping and die cutting, but need not be limited to these methods.

Figure 5:
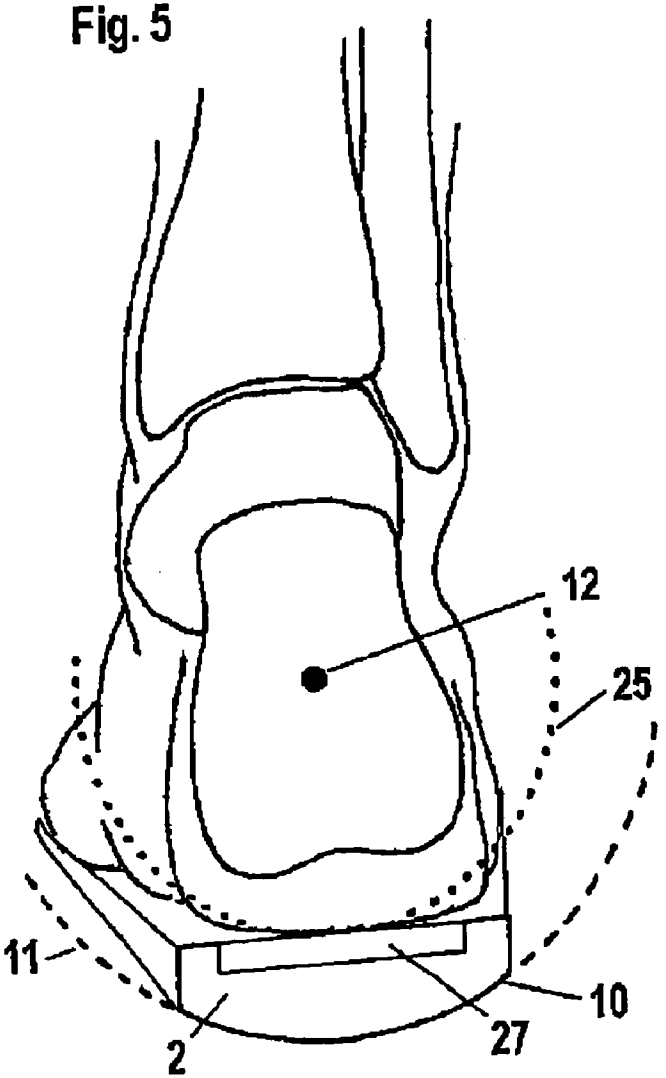
FIG. 5 is a posterior aspect view of another aspect of the invention illustrating a foot positioned normally on a midsole/outsole arrangement, and showing a radial midsole/outsole arrangement as well as a cushioning region plantar to the location of the foot's calcaneus.

According to another aspect of the invention, as illustrated in FIG. 5, a preferred embodiment is presented wherein an article of footwear 1 has a midsole/outsole 2 having a wearing layer 10. The wearing layer 10 may be fabricated from polymers known to the footwear industry as displaying the abrasion and cut resistance properties required to offer shape retention and durability, these include compounds primarily made of rubber and polyurethane, but need not be limited to these compounds. The midsole/outsole 2 may also be fabricated through means and of materials common to the footwear industry but need not be limited to those materials and/or means.

Figure 7:
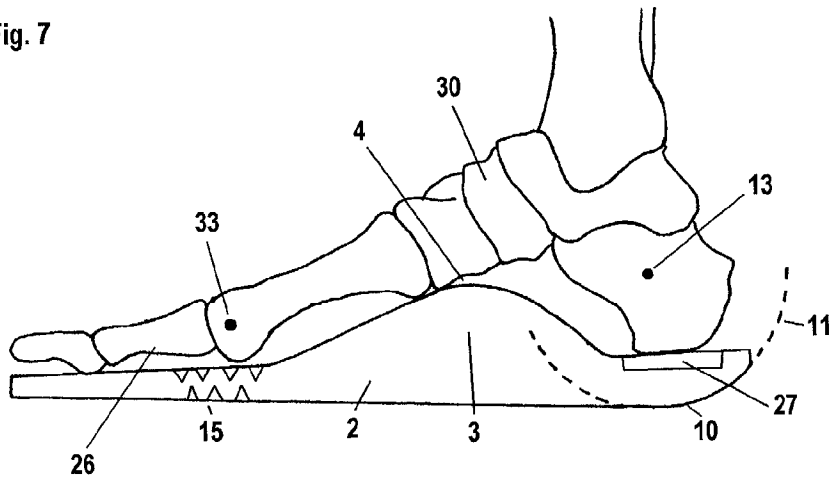
FIG. 7 is a medial sagittal view of a skeletal foot positioned, in the desired location, on a midsole/outsole unit illustrating preferred embodiments of the invention having; a radial midsole/outsole arrangement, forefoot flex grooves or channels, a cushioning region plantar to the location of the foot's calcaneus and the positioning of a substantially dome shaped catalyst alignable with the plantar aspect of the foot to a target area.

The midsole/outsole 2 of the present invention is also characterized by a novel radial geometry 11 having a geometric centre alignable with a region approximating the long axis of rotation 12 of a biomechanically stable foot when viewed from the posterior aspect, and alignable with the region of the sagittal plane centre of mass of the calcaneus 13, when viewed from a sagittal plane aspect, as shown in FIG. 7. In this manner the foot is encouraged to contact the ground or support surface and come to a resting position in a manner that reduces the unnecessary torques and accelerations that accompany conventional midsole/outsole designs. This is achievable by radially aligning the centre of curvature of the curved heel region of the midsole/outsole with the pivotable centre of the calcaneus.

Figure 6:
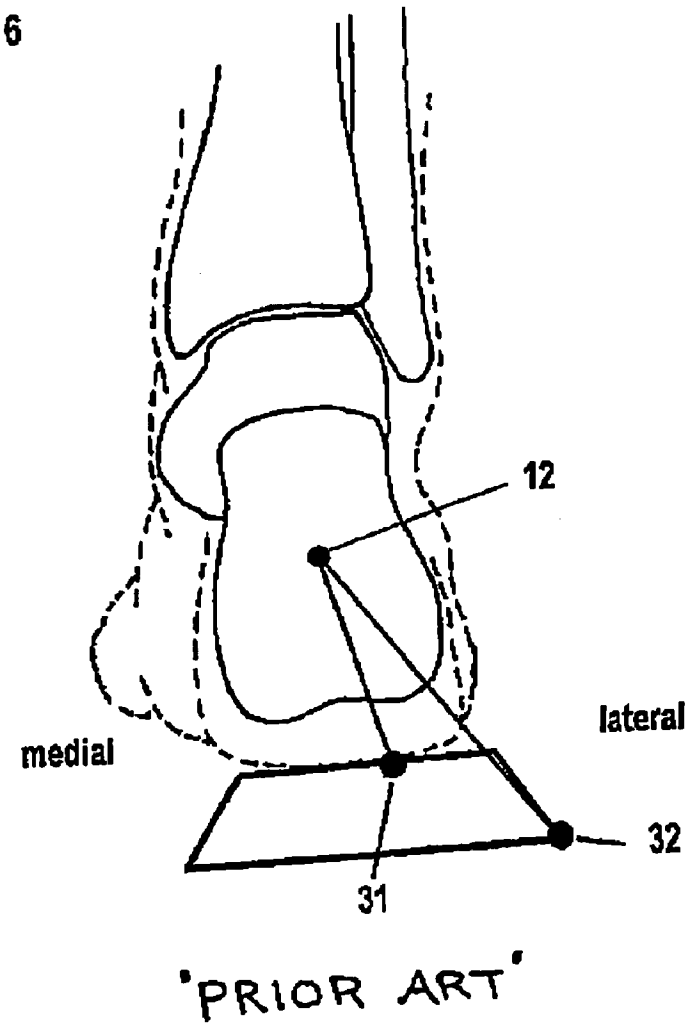
FIG. 6 is a posterior aspect view of a foot positioned normally on a midsole/outsole arrangement according to the present invention, and showing a traditional midsole/outsole arrangement indicating lever arms about the foot's long axis of rotation, contrasting that of an ideal barefoot environment to that experienced when shod in traditional footwear.

FIG. 6 illustrates the common relationship between the foot and a traditionally configured midsole/outsole unit. The unshod foot most notably comes in contact with the ground or support surface at an unshod contact point 31 which produces a lever arm equivalent to the distance measurable from the long axis centre of rotation 12 of the foot and the unshod contact point 31. The introduction of footwear with midsole/outsole units results in the modification of the contact point such that the shod contact point 32 has been translated both laterally and inferiorly relative to the unshod contact point 31. This results in an increased lever being measurable as the distance from the long axis centre of rotation 12 of the foot and the shod contact point 32. Those skilled in the art of gait biomechanics will appreciate the increases in forces, torques and accelerations that accompany increases in the lever arm from the point of rotation to the point of contact.

FIG. 7 illustrates the radial geometry 11 of the midsole/outsole 2 when viewed from a sagittal aspect.

According to another embodiment of the invention, FIG. 5 and FIG. 7 illustrate a cushioning region 27 which is alignable with the plantar surface of the heel of the wearer; and which is more easily compressible than the surrounding midsole/outsole making up the periphery of the cushioning region. The cushioning region 27 may be fabricated through a variety means, and of a variety of materials common to the footwear industry but need not be limited to those materials and/or means. The enhanced compressibility of the cushioning region 27 may also be attainable through the strategic implementation of a cavity devoid of any materials at all and in which case the resiliency and durability of the midsole/outsole 2 is solely dependent upon the engineering and design of the materials surrounding the cavity. The purpose of the cushioning region 27 is to enhance the placement of the foot and ensure that during gait the foot comes slowly to rest in the most biomechanically efficient position possible.

FIG. 7 also illustrates the relationship between the foot of the wearer and the midsole/outsole 2 when viewed from the sagittal plane, and the positional relationship of the flex grooves or channels 15 with the head of the first metatarsal bone 26.

Figure 8:
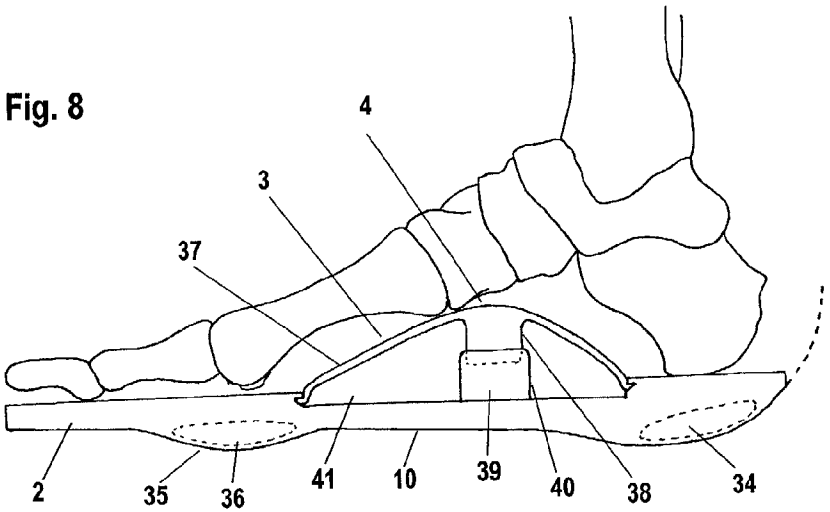
FIG. 8 is a view corresponding to FIG. 7 but illustrating an alternate embodiment dome shaped catalyst and further illustrating a cushioning region plantar to the location of the foot's calcaneus and a further cushioning region plantar to the metatarsal region with a cushioning region positioned to be adjacent the wearing layer.

FIG. 8 provides a sagittal view of the midsole/outsole 2 with alternative embodiments of the wearing layer 10 wherein the wearing layer has a dominant heel portion with a rearfoot radial geometry 11 region mirroring the non weight bearing calcaneus shape 25 and a forefoot radial geometry region 35. The midsole/outsole 2 in the region of the rearfoot radial geometry 11 region may also include a plantar cushioning region 34 alignable with the plantar surface of the heel of the wearer with respect to the medial, lateral, posterior and anterior planes. The plantar cushioning region may be constructed of such materials and in such configuration as to allow it to be more easily compressed than the surrounding midsole/outsole 2 making up the periphy of the plantar region 34. The purpose of the plantar rearfoot cushioning region 34 is to enhance the placement of the foot and ensure that during gait the foot comes slowly to rest in the most biomechanically efficient position possible.

The forefoot radial geometry region 35 may possess a forefoot cushioning region 36 which is more easily compressed than the remainder of the outsole/midsole 2 surrounding the forefoot region. The curvilinear nature of the forefoot radial geometry region 35 closely parallels the radial nature of the forefoot when the long axis centre of rotation is used as a geometric centre of rotation for the curve. The forefoot cushioning region 36 should deflect in a manner during weight bearing as to ensure the natural and central placement of the foot about the midsole/outsole 2. In this manner the energies associated with initial contact are minimized and the forefoot is encouraged to maintain a biomechanically ideal placement dorsal to the midsole/outsole 2.

FIG. 8 also illustrates another embodiment wherein the midsole/outsole 2 has a substantially dome shaped catalyst 3 with a distinct apex 4 which is alignable with a desired target area 5 of the foot. The dome shaped catalyst 3 may have an outer shell 37 and a centralized pillar 40. The centralized pillar 40 maybe constructed in one part of materials providing the compression, deflection and rebound characteristics required for the substantially dome shaped catalyst to function as desired. Alternatively the dome shaped catalyst 3 may be constructed such that the pillar 40 has a piston 38 and cylinder 39 wherein the movement of the piston 38 within the cylinder 39 is regulated through appropriate selection of filler material within the cylinder such that the movement of the piston 38 within cylinder 39 provides the desired deflection, compression and rebound characteristics. In this arrangement the substantially dome shaped catalyst 3 has, plantar to its outer shell 37, regions or voids 41. These voids 41 may be left empty or may be filled with foams, fluids, bladders or gases etc. to provide structural integrity to the substantially dome shaped catalyst 3 in such a manner as to ensure the maintenance of the desired deflection, compression and rebound characteristics.

To allow for a progression in the resistance created by the substantially dome shaped catalyst 3 the composition, design, and material selection of any of the outer shell 37, the pillar 40, the piston 38, and the cylinder 39 maybe altered in such a manner as to allow variability and control of the compression, deflection and rebound properties of the substantially dome shaped catalyst 3. Further control and variability of the compression, deflection and rebound properties of the substantially dome shaped catalyst 3 may be achieved through the selection of materials chosen to fill the voids 41.

Figure 9:
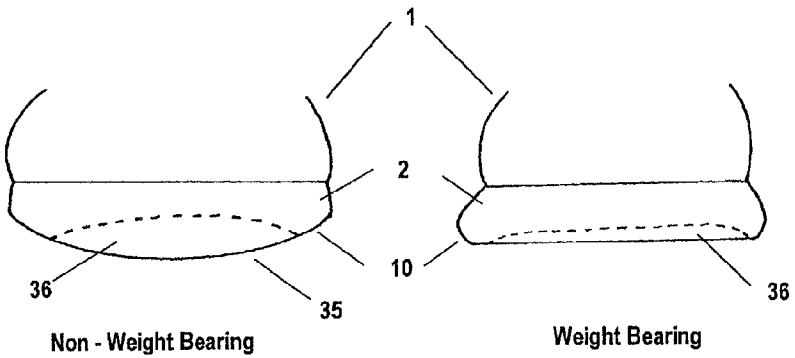
FIG. 9 is a frontal view of a shoe upper and midsole/outsole arrangement through a section defined by the metatarsal flex line in both a weight bearing and non weight bearing scenario illustrating a midsole/outsole with a radial geometry in a non compressed state and in a compressed state attributable to the bearing of the users body weight.

FIG. 9 illustrates, through the frontal plane, an article of footwear 1 with a midsole/outsole 2 in both a weight bearing and a non weight bearing condition. The midsole/outsole 2 has a wearing layer 10 and a forefoot radial geometry region 35 which may possess a forefoot cushioning region 36 more easily compressible than the surrounding area forming the midsole/outsole of the forefoot region. In the non weight bearing condition the curvilinear nature of the forefoot radial geometry region 35 closely parallels the radial nature of the forefoot when the long axis centre of rotation is used a geometric centre of rotation for a curve. The forefoot cushioning region 36 should deflect in the manner illustrated, during weight bearing as to ensure the natural and central placement of the foot about the midsole/outsole 2. In this manner the energies associated with initial contact are minimized and the forefoot is encouraged to maintain a biomechanically ideal placement dorsal to the outsole/midsole 2.

Figure 10:
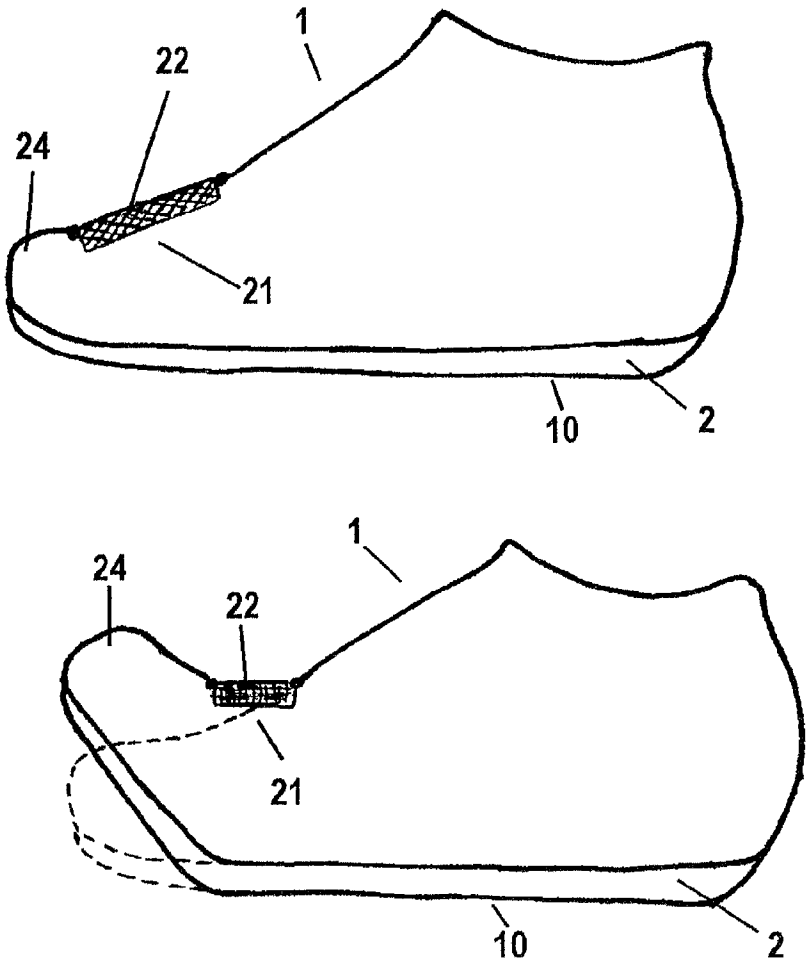
FIG. 10 is a lateral sagittal plane view of another embodiment of the invention illustrating a shoe, with a distinct toe box, in a relaxed state and in a dorsi-flexed state with toes raised, and illustrating a strain resistance device fabricated of elastic fibers.
Figure 11:
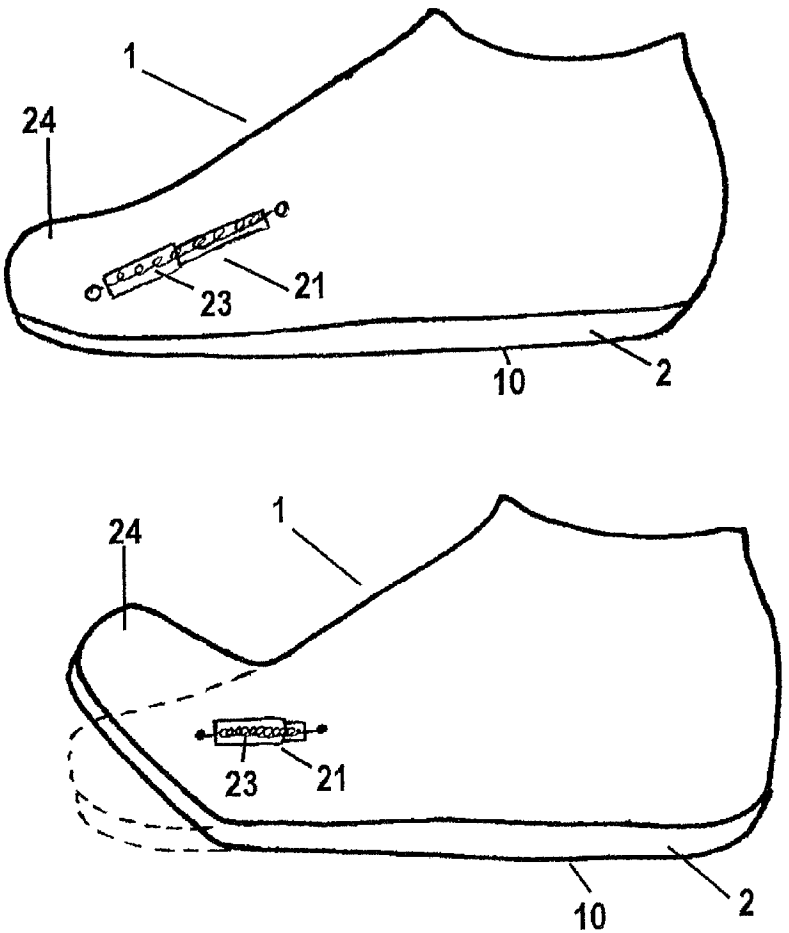
FIG. 11 is a lateral sagittal plane view of a shoe, with a distinct toe box, in a relaxed state and a dorsi-flexed state with toes raised, and illustrating a strain resistance device fabricated of coiled springs; and, FIG. 12 is a lateral sagittal plane view of a shoe, with a distinct toe box, in a relaxed state and a dorsi-flexed state with toes raised, and illustrating a strain resistance device integrated into the midsole/outsole design.

FIGS. 10 and 11 illustrate yet another embodiment of the present invention according to which an article of footwear 1 is provided with a strain resistance device 21 designed and positioned such that its resting tension is achieved only when the upper of said article of footwear 1 is in a maximally dorsi-flexed position definable by the toes of the wearer being maximally raised. By encouraging such dorsi-flexion it is an object of the present invention to allow full accomplishment of the foot's Windlass Effect, and the resulting stabilization of the foot that accompanies the Windlass Effect. As presented earlier, the ability to utilize the Windlass Effect allows for the pre-stabilization of the foot prior to initial contact and the maintenance of the foot's structural integrity during the midstance phase of gait. The strain resistance device 21 is designed and positioned to pull or push the toes upwardly during the swing phase of gait and work in harmony with the desire of the toes to dorsi-flex during the same phase in the gait cycle.

The strain resistance device 21 may take the form a band of elastic fibers 22 or coiled springs 23, or the like, that exhibit tension in the direction of pull created as the toes attempt to plantar flex. The strain resistance device 21 should be positioned superior to the first metatarsal sagittal plane axis of rotation 33 of the first metatarsal 26. With the such positioning, as such a moment arm is created resulting in the achievement of the desired dorsi flexing action through a pulling motion. The strain resistance device 21 may be constructed from a variety of materials and in a variety of configurations.

Figure 12:
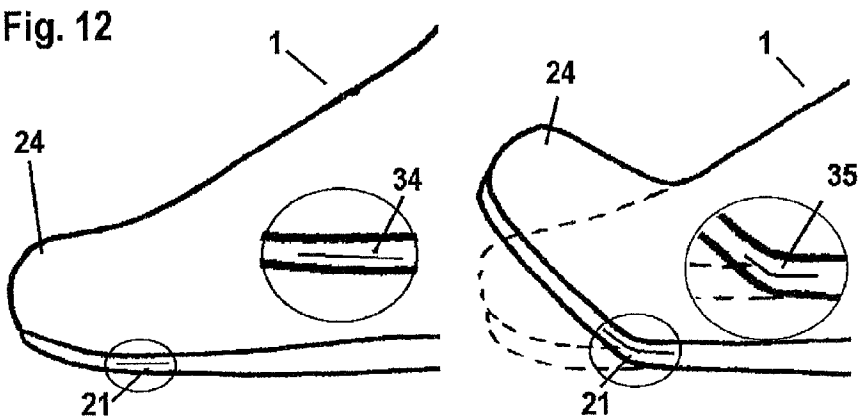

In FIG. 12 another embodiment of the invention is illustrated wherein the strain resistance device 21 is integrated into the midsole/outsole 2 of the article of footwear 1. As shown the strain resistance device 21 may take the form of a cantilever spring positioned in the shoe's midsole/outsole 2, wherein the position of the relaxed state cantilever 35 is consistent with the dorsi-flexed state of the toes of the foot. During the stance phase of the gait cycle however the cantilever spring assumes a stressed state cantilever shape 34 and in its desire to assume its relaxed state it generates a push effect enhancing the dorsi-flexion of the toes. In this configuration the strain resistance device 21 may be constructed from, among other materials, a variety of polymers and layered laminates and in a variety of configurations as would be apparent to one skilled in the art of such cantilever structures.

To fully maximize the ability of the toes to be dorsi-flexed through the swing phase of the gait cycle it is desirable that flex grooves or channels 15 cooperate with the strain resistance device 21 and also that the toe box 24 of the article of footwear 1 be designed such that it is capable of allowing maximal dorsi-flexion of the toes of the foot without providing any resistance to the dorsi flexing action.

The above description is intended in a illustrative rather than a restrictive sense as no doubt other embodiments will suggest themselves to persons skilled in the relevant arts without departing from the spirit and scope of the invention as defined by the claims set out below.

We claim:

1. An article of footwear comprising:

an upper for covering of a wearer's foot;

a midsole/outsole secured to said upper for covering a sole of said wearer's foot and having an inside face adjacent said sole and an outside face for interfacing with an underlying surface;

said midsole/outsole having a region of enhanced flexibility corresponding to a metatarsal region of a person's foot defined by a medial posterior boundary not less than 70% of the length of said midsole/outsole, a medial anterior boundary not more than 80% of the length of said midsole/outsole a lateral anterior boundary not more than 70% of the length of said midsole/outsole and a lateral posterior boundary not more than 60% of the length of said midsole/outsole; and said midsole/outsole has a heel region corresponding with a wearer's heel and a convex curvature to said outer face in said heel region; said convex curvature has a radius of curvature approximately coincident with a long axis of rotation of said wearer's foot and with a sagittal plane centre of mass of a calcaneus of said wearer's foot.

2. An article of footwear as claimed in claim 1 wherein:

said region enhanced flexibility is provided by transversely extending grooves formed in said midsole/outsole in said region.

3. An article of footwear as claimed in claim 2 wherein:

at least one of said upper and said midsole/outsole are provided with biasing means acting to urge said region of flexibility toward a position corresponding to a dorsi-flexed state.

4. An article of footwear as claimed in claim 1 wherein:

said midsole/outsole arrangement further has a substantially dome shaped catalyst for interfacing with the plantar aspect of a wearer's foot;

said catalyst has an apex for aligning with a target area within said wearer's foot, said target area being defined by the point of articulation of the lateral cuneiform, cuboid and navicular bones of said wearer's foot, to permit uninhibited triplanar pivoting of the foot about the target area;

said catalyst displaying compression and rebound properties such that said catalyst is capable of applying an upwardly directed pressure to stimulate the Golgi tendon organ as of said wearer's foot in response to downward pressure on said catalyst by said foot; and, said catalyst has a maximum height of said apex of from 1% to 5% of the length of said midsole/outsole.

5. An article of footwear as claimed in claim 4 wherein:

said heel region includes a cushioning region corresponding to said wearer's calcaneus, said cushioning region being more easily compressible than a remainder of said midsole/outsole arrangement surrounding said heel region.

6. An article of footwear as claimed in claim 4 wherein:

said catalyst has a receptacle for removably accommodating a resilient member for causing said catalyst to apply said upwardly directed pressure.

7. An article of footwear as claimed in claim 6 wherein:

said receptacle has sidewalls perpendicular to said outer face of said midsole/outsole for interfacing with vertical sides of said resilient member to oppose horizontally directed forces.

8. An article of footwear as claimed in claim 1, 2 or 3 wherein:

said heel region includes a cushioning region corresponding to said wearer's calcaneous, said cushioning region being more easily compressible than a remainder of said midsole/outsole arrangement surrounding said heel region.

* * * * *